United States Patent [19]

Klös

[11] Patent Number: 4,688,598

[45] Date of Patent: Aug. 25, 1987

[54] RIBBON AND METHOD AND MECHANISM FOR MAKING THE SAME

[75] Inventor: Heinrich Klös, Bernkastel, Fed. Rep. of Germany

[73] Assignee: Mageba Textilmaschinen GmbH, Fed. Rep. of Germany

[21] Appl. No.: 721,245

[22] Filed: Apr. 8, 1985

[30] Foreign Application Priority Data

Apr. 7, 1984 [DE] Fed. Rep. of Germany ..... 3413258

[51] Int. Cl.[4] ..... D03D 5/00

[52] U.S. Cl. ..... 139/383 R; 139/432; 139/431

[58] Field of Search ..... 139/430, 431, 432, 116, 139/383 R, 429

[56] References Cited

U.S. PATENT DOCUMENTS

| | | | |
|---|---|---|---|
| 4,202,381 | 5/1980 | Bucher | 139/383 R |
| 4,344,463 | 8/1982 | Müller et al. | 139/383 R |
| 4,436,121 | 3/1984 | Cheynet | 139/116 |

*Primary Examiner*—Stephen Marcus
*Assistant Examiner*—Tracy Graveline
*Attorney, Agent, or Firm*—Ward Brown; Robert W. Beach

[57] ABSTRACT

A knitted selvage is formed along an otherwise woven ribbon by tying off loops of filling thread inserted into successive sheds of warp threads. A primary selvage thread is drawn through each loop of filling thread along with only one of two auxiliary selvage threads, the auxiliary selvage threads being drawn alternately through successive loops with the primary selvage thread.

9 Claims, 20 Drawing Figures

RIBBON AND METHOD AND MECHANISM FOR MAKING THE SAME

BACKGROUND OF THE INVENTION

1. Field of the Invention

The present invention relates to a woven ribbon with a knitted selvage and a method and mechanism for manufacture of such ribbon.

2. Prior Art

Known woven ribbons have the disadvantage of raveling when their threads are cut or broken. There are prior machines for forming a selvage but the resulting ribbons still may ravel and such machines are complicated and expensive.

SUMMARY OF THE INVENTION

The principal object of the present invention is to provide a novel ribbon, and a method and mechanism for manufacturing such ribbon, with a selvage reliably preventing raveling if filling threads of the ribbon are cut or broken.

In the preferred embodiment of the present invention, the foregoing object is accomplished by providing a woven ribbon with loops of filling or weft thread woven with warp threads, and a knitted selvage having a primary selvage thread drawn through each filling or weft thread loop as the ribbon is formed. At least two other auxiliary selvage threads are guided by heddles similar to the ribbon warp threads. The two auxiliary selvage threads are alternately drawn through the filling or weft thread loops with the primary selvage thread.

DETAILED DESCRIPTION

Figure 1:
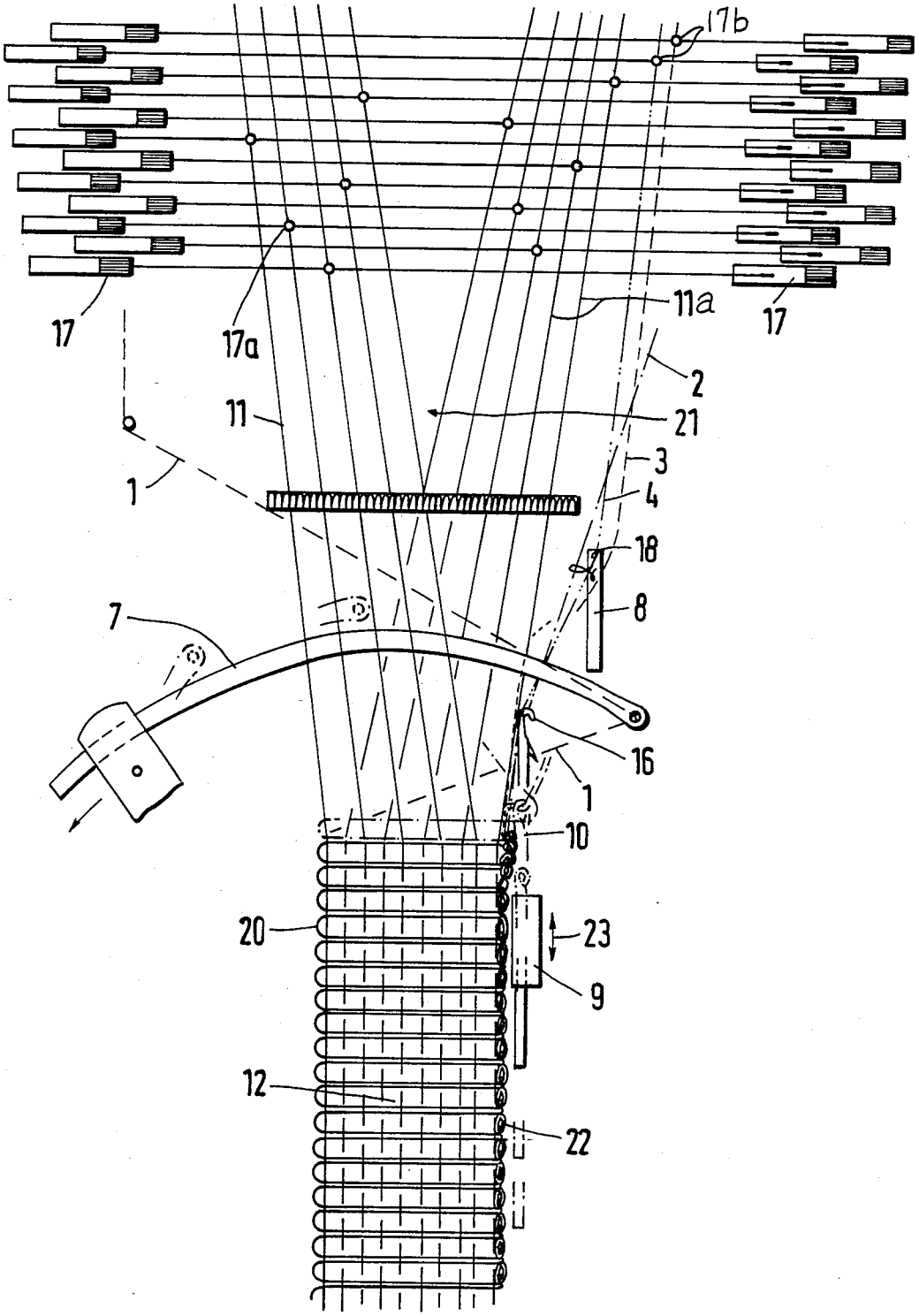
FIG. 1 is a diagrammatic and schematic illustration of a ribbon and ribbon-weaving machine in accordance with the present invention.

As illustrated in FIG. 1, a ribbon 12 in accordance with the present invention is formed by a filling or weft thread 1 looped through the shed 21 between oppositely-inclined warp threads 11 and 11*a* by a reciprocating shuttle bar or needle 7. The shed 21 is formed in the usual manner with heddle shafts 17 carrying the heddles 17*a* for the warp threads. The shuttle bar 7 is mounted at one side 20 of the shed and ribbon which side is referred to as the "woven side".

At the opposite side of the shed and ribbon—the "knitted side" 22—two auxiliary selvage threads 3 and 4 are guided by separate heddles 17*b* similar to the guiding of the warp threads 11 and 11*a* by their heddles 17*a*. For each shed formed by the oppositely-inclined warp threads 11 and 11*a*, one of the heddles 17*b* holds its auxiliary selvage thread in generally the same relative position as the heddles 17*a* for the warp threads 11 and the other heddle 17*b* holds its auxiliary selvage thread in generally the same relative position as the heddles 17*a* for the warp threads 11*a*. Consequently, for each shed one of the auxiliary selvage threads extends above the central plane of the shed and the other extends below the central plane of the shed.

The supply mechanism (not shown) for the auxiliary selvage threads is separate from the supply mechanism (not shown) for the warp threads.

Figure 11:
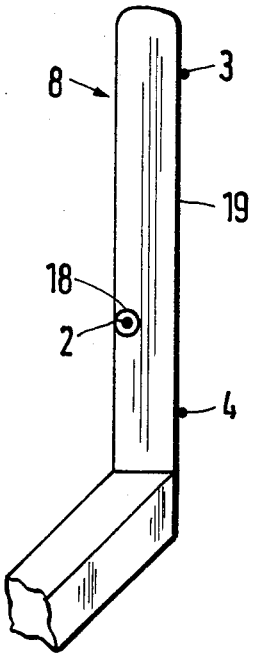
FIG. 11 is a diagrammatic, fragmentary, top perspective of a component of the machine shown in FIG. 1, namely, the selvage thread guide.
Figure 12:
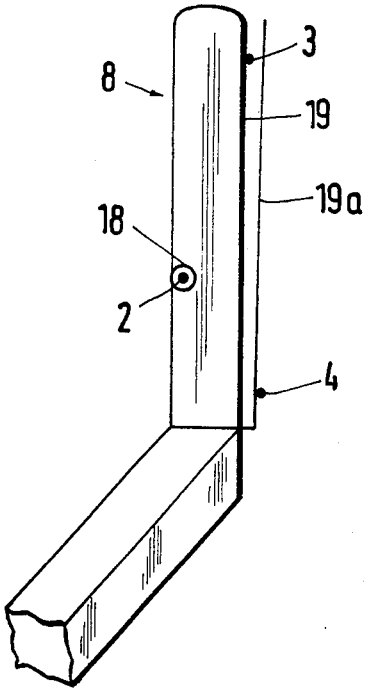
FIG. 12 is a diagrammatic, fragmentary, top perspective of an alternative selvage thread guide.

At the knitted side of the ribbon adjacent to the auxiliary selvage threads 3 and 4 a separate primary selvage thread 2 is controlled by a thread guide 8. As diagrammatically represented in FIG. 11, the thread guide has an aperture through which the primary selvage thread 2 passes and an upright guiding surface 19 against which the auxiliary selvage threads 3 and 4 rest. As seen in FIG. 12, in an alternative embodiment the thread guide 8 can have an additional guiding surface 19*a* which also is upright and substantially parallel to the guiding surface 19 so that the auxiliary selvage thread 3 rests on the guiding surface 19, whereas the auxiliary selvage thread 4 rests on the outer guiding surface 19*a*. Separate guiding surfaces 19 and 19*a* prevent the auxiliary selvage threads 3 and 4 from coming into contact when a new shed 21 is formed by shifting the heddles 17*a* and 17*b*. Either thread guide is preferably a bent steel wire.

Returning to FIG. 1, on the knitted side 22 of the ribbon-weaving machine, a knitting latch needle 10 is mounted for longitudinal reciprocation fore and aft in generally the central plane of the shed as represented by the arrow 23. Such needle is carried in a needle block 9 so that the longitudinal position of the needle can be adjusted. The mouth of the knitting needle preferably opens toward the bottom of the shed and can be closed by the latch or tongue 16.

With the shuttle bar or needle 7 in the projected position shown in FIG. 1, where the filling or weft thread 1 forms a loop inside the shed as shown in broken lines, and with the thread guide 8 moved up to about the central plane of the shed, the knitting needle 10 is moved forward to grasp the primary selvage thread 2 and whichever of the auxiliary selvage threads 3 and 4 is held down by its heddle 17*b*. When the knitting needle is pulled back, it carries with it the primary selvage thread 2 and such auxiliary selvage thread so that they are both drawn together back through the loop of filling thread 1.

Figure 2A:
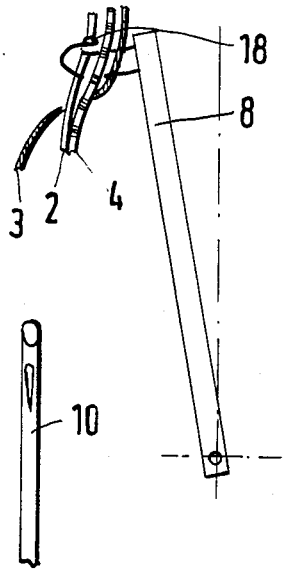
FIGS. 2*a*, 3*a*, 4*a* and 5*a* are corresponding, diagrammatic, fragmentary, side elevations of the machine of FIG. 1 with parts deleted and parts in different positions.
Figure 2B:
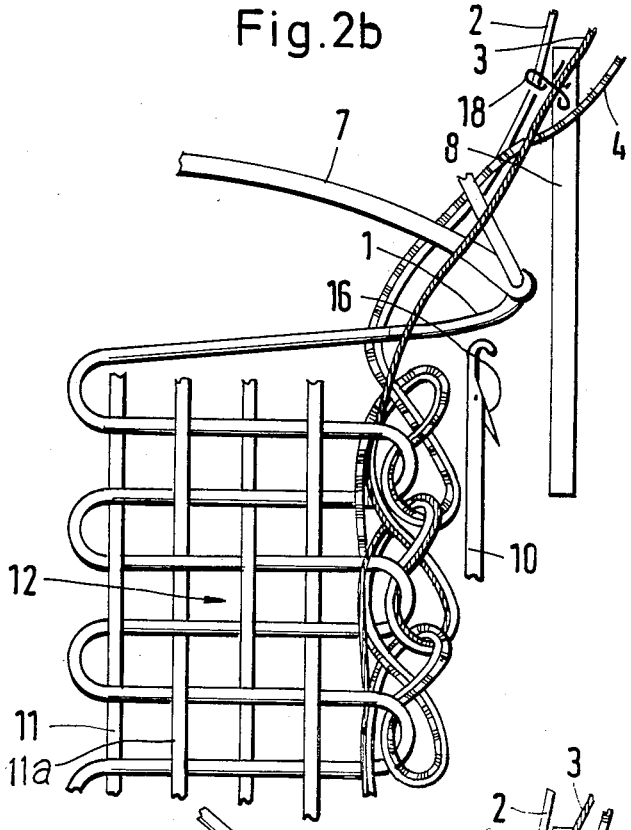
FIGS. 2*b*, 3*b*, 4*b* and 5*b* are diagrammatic, fragmentary, substantially top plans of the ribbon and machine of FIG. 1 with parts in the same positions as in FIGS. 2*a* through 5*a*, respectively.
Figure 3A:
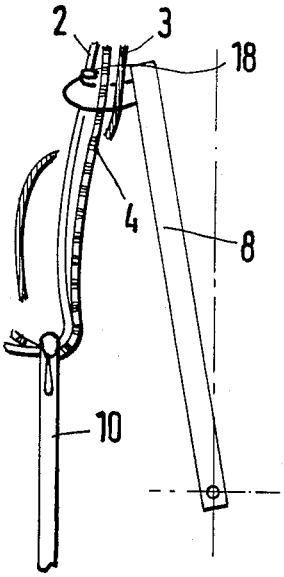
Figure 3B:
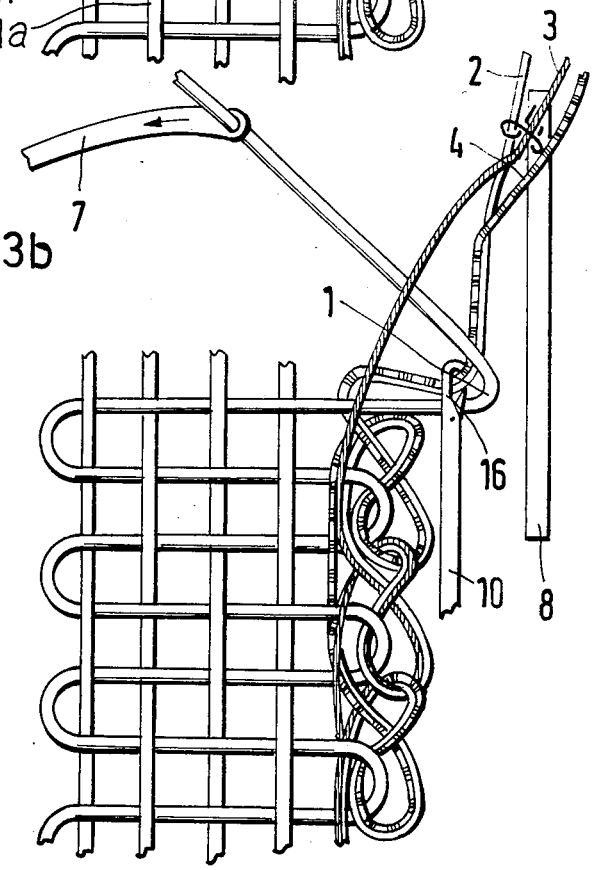
Figure 4A:
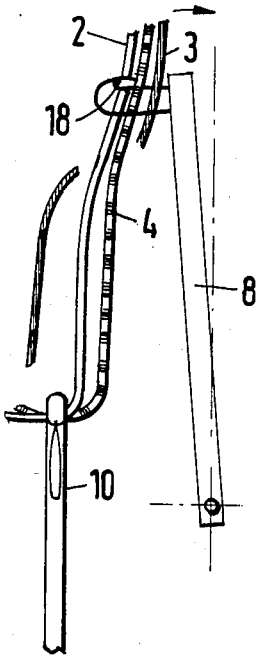
Figure 4B:
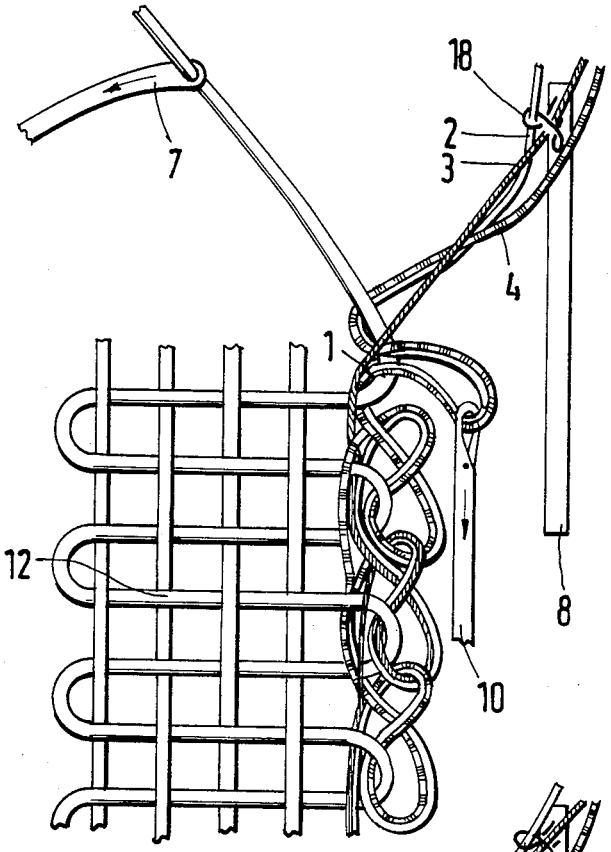

More specifically, the operation of the machine is shown in FIGS. 2*a* through 5*a* and 2*b* through 5*b*. The "b" figures show the ribbon and machine substantially in top plan, and the "a" figures show the position of the thread guide 8 and knitting needle 10 in side elevation. As seen in FIGS. 2*a* and 2*b*, with auxiliary selvage thread 3 positioned at the top of the shed and with the primary selvage thread 2 and auxiliary selvage thread 4 positioned at about the center of the shed, and with the shuttle bar 7 extended to form the loop of filling thread 1, the knitting needle 10 is moved forward to hook the primary selvage thread 2 and the auxiliary selvage thread 4. It will be noted that the thread guide 8 is in its upward swung position to dispose the primary selvage thread 2 and the auxiliary selvage thread 4 for being hooked by the knitting needle. As indicated in FIGS. 3*a* and 3*b* and FIGS. 4*a* and 4*b*, the knitting needle is moved rearward to carry with it the primary selvage thread 2 and the auxiliary selvage thread 4 as the shuttle bar 7 is moved back out of the shed and as the thread guide 8 is moved downward.

Figure 5A:
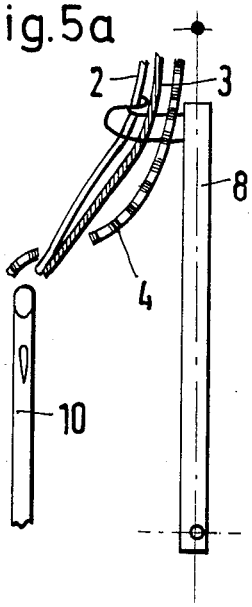
Figure 5B:
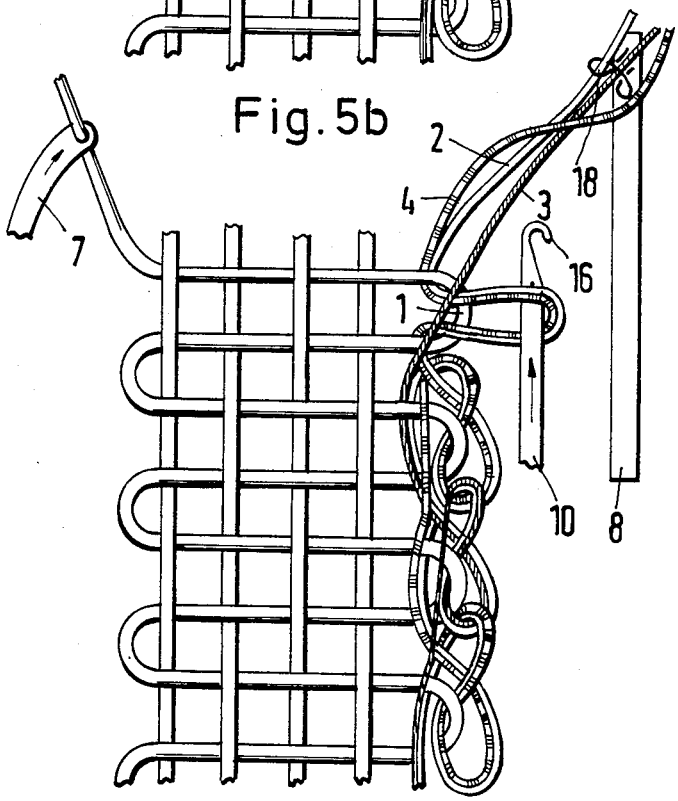
Figure 6A:
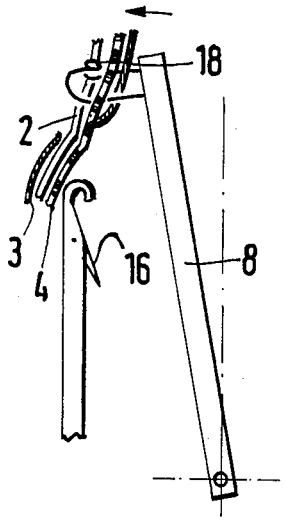
FIGS. 6*a*, 7*a*, 8*a* and 9*a* are diagrammatic, fragmentary, side elevations of an alternative ribbon-weaving machine in accordance with the present invention with parts deleted and parts in different positions.
Figure 6B:
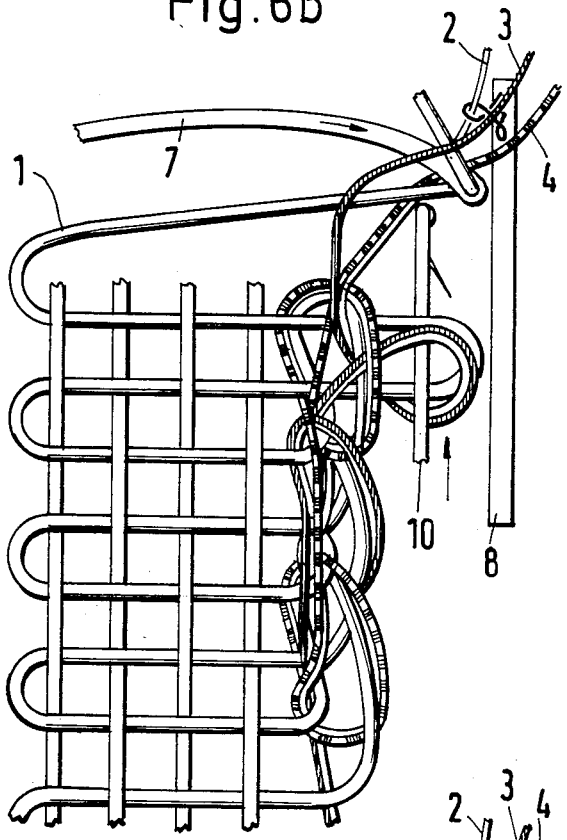
FIGS. 6*b*, 7*b*, 8*b* and 9*b* are corresponding, diagrammatic, fragmentary, substantially top plans of an alternative ribbon and machine in accordance with the present invention with parts in the same positions as in FIGS. 6*a* through 9*a*, respectively.
Figure 7A:
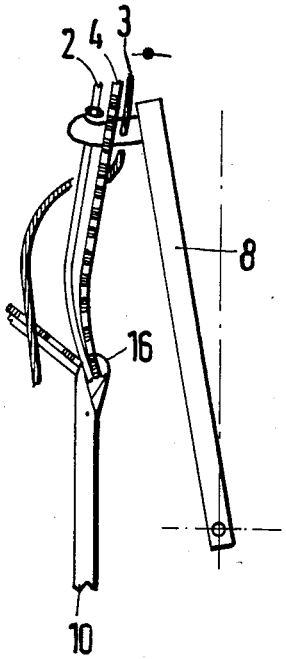
Figure 7B:
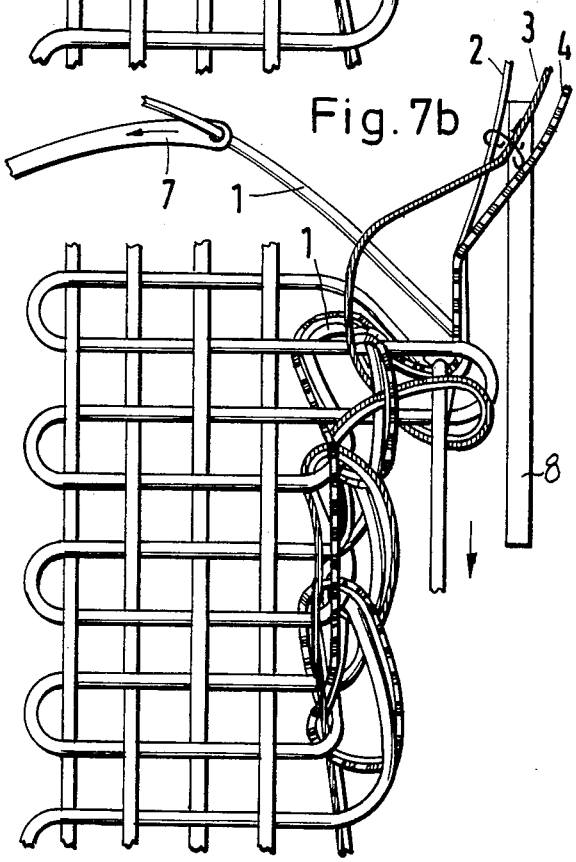
Figure 8A:
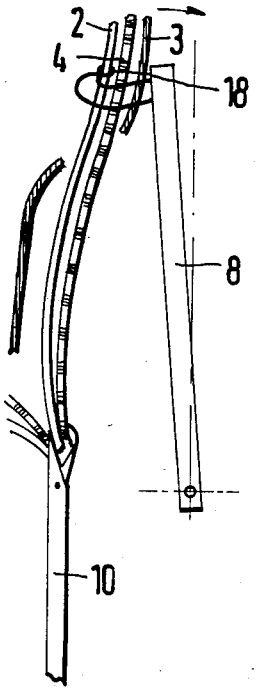
Figure 8B:
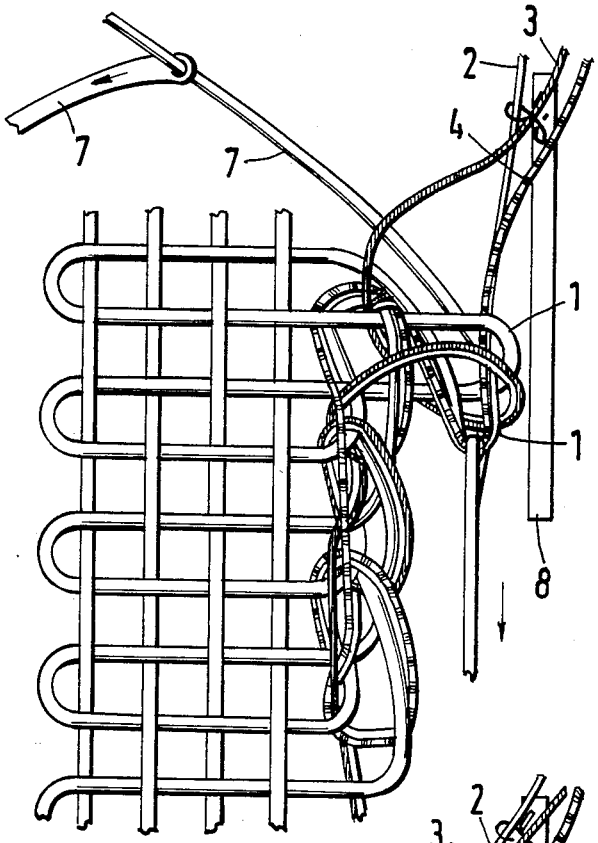

Next, a new shed is formed by shifting the positions of the warp threads 11 and 11*a* and, at the same time, the auxiliary selvage threads 3 and 4 are shifted. As illustrated in FIGS. 5*a* and 5*b*, the shuttle bar 7 is moved through the new shed and the knitting needle 10 is ready to be moved forward to hook the primary selvage thread 2 and the auxiliary selvage thread 3 which now is positioned toward the bottom of the shed but which is moved upward to about the center of the shed by the thread guide 8. The primary selvage thread 4 will not be hooked because of its movement toward the top of the new shed by its heddle.

Consequently, while selvage thread 2 is drawn through each loop of filling thread, the auxiliary selvage threads alternate in being drawn through the loops with the primary selvage thread. The knitted selvage securely ties off each loop of filling thread so that in case of cutting or breaking no raveling occurs.

For the most secure tying off of the filling thread loops, the auxiliary selvage threads can be different diameters, preferably different unshrunk yarns at least one of which is textured.

Figure 9A:
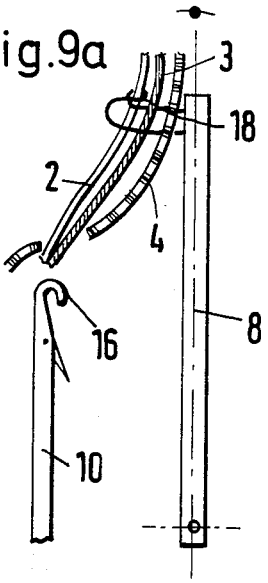
Figure 9B:
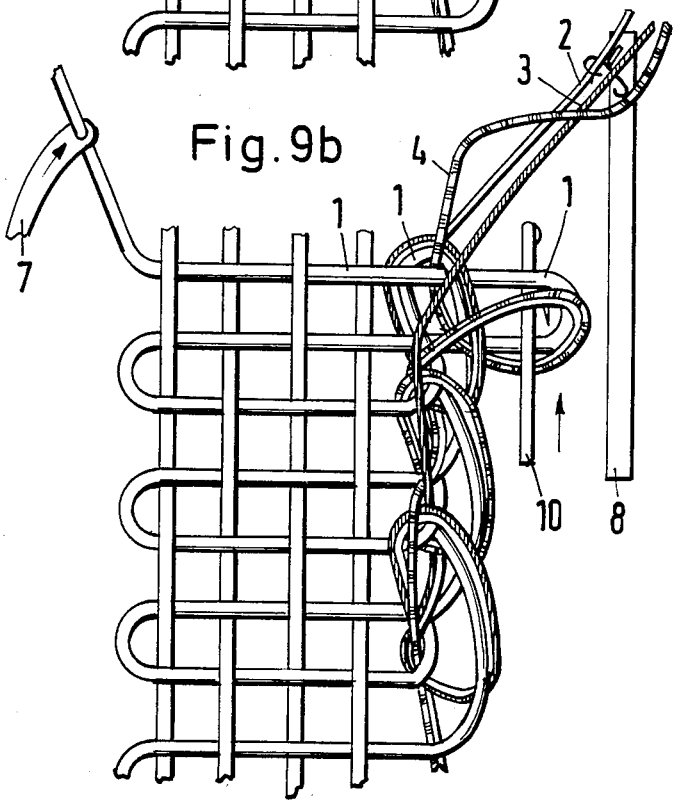

Essentially the same ribbon weaving and selvage knitting procedure is shown in FIGS. 6*a* through 9*a* and 6*b* through 9*b*, with the difference that the loops of filling thread 1 are drawn through the previously formed loops along with the primary selvage thread 2 and, alternately, the auxiliary selvage threads 3 and 4. As best seen in FIGS. 7*a* and 7*b*, each loop of filling thread 1 is positioned by the shuttle bar 7 to be hooked by the knitting needle 10 along with the primary selvage thread 2 and one of the auxiliary selvage threads 3 and 4. The previous loop extends around the knitting needle so that as the knitting needle is moved rearward the next loop is drawn back through the previous loop along with the appropriate selvage threads. When the next shed is formed by movement of the warp threads, the positions of the auxiliary selvage threads are changed, and the knitting needle slides forward as indicated in FIGS. 9*a* and 9*b* in the just-completed loop to catch the next loop of filling thread, the primary selvage thread and the other auxiliary selvage thread. Consequently, the loops, themselves, are knitted together to form a secure selvage along with the selvage threads.

Figure 10:
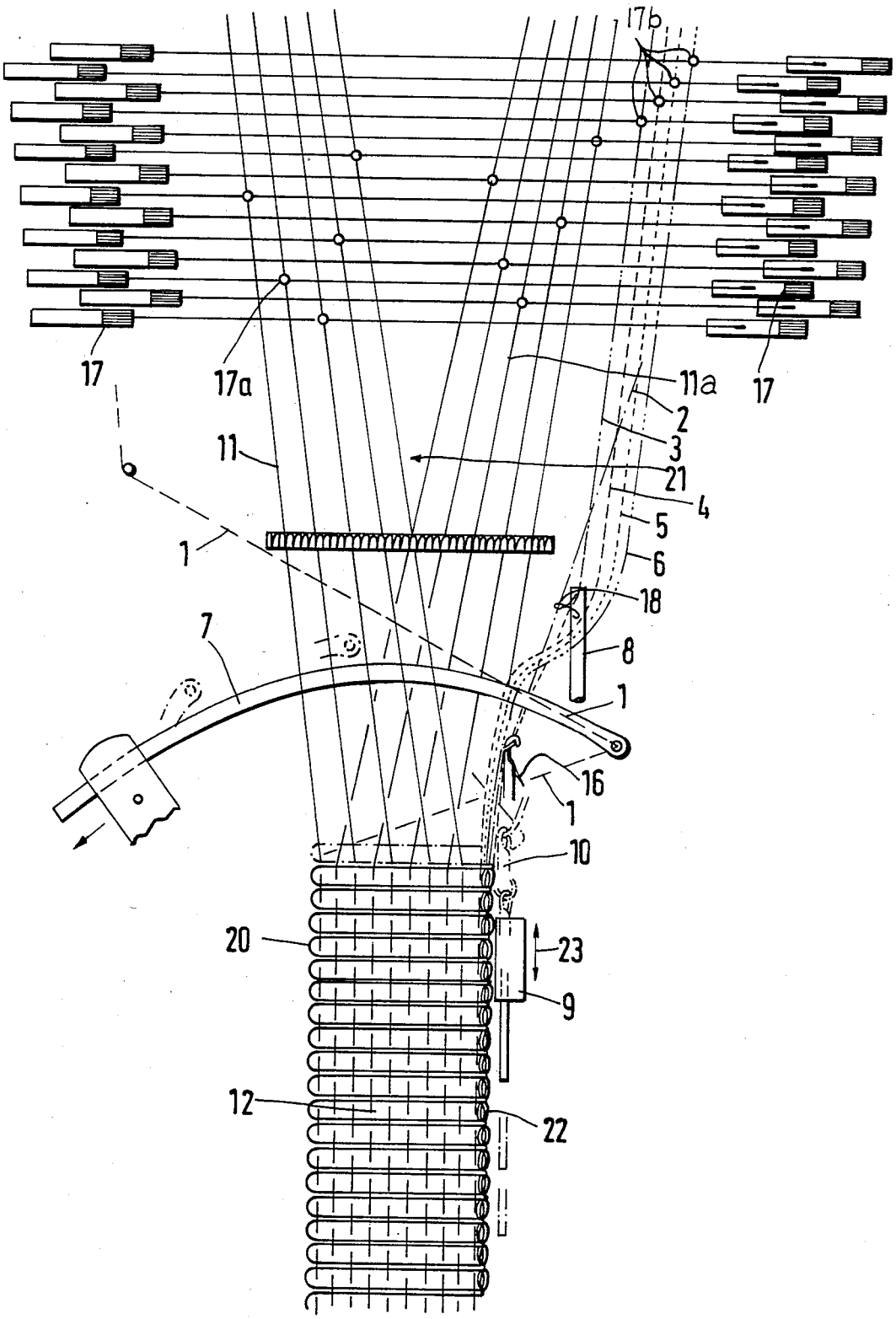
FIG. 10 is a diagrammatic and schematic, fragmentary illustration of another alternative ribbon and ribbon-weaving machine in accordance with the present invention.

In a further modification, the weaving loom can use more than two auxiliary selvage threads. FIG. 10 illustrates schematically a machine having auxiliary selvage threads 5 and 6 in addition to auxiliary threads 3 and 4, along with the primary selvage thread 2. Each auxiliary thread is guided by its own heddle 17*b* in addition to the thread guide 8. The heddles for the four auxiliary threads can be moved downward in sequence with formation of new sheds for knitting the primary selvage thread and, first, auxiliary thread 3, then auxiliary thread 4, then auxiliary thread 5, then auxiliary thread 6 as the successive sheds are formed. Alternatively, different combinations of three selvage threads can be knitted into successive loops, such as threads 2, 3 and 4, then threads 2, 4 and 5, then threads 2, 5 and 6, then threads 2, 3 and 6, for even greater protection against raveling of the completed ribbon.

I claim:

1. A ribbon comprising longitudinally-extending warp threads, loops of filling thread extending transversely of and woven through said warp threads, a primary selvage thread knitted through each filling thread loop, and first and second auxiliary selvage threads each knitted through alternate filling thread loops with said primary selvage thread.

2. The ribbon defined in claim 1, in which each loop of filling thread is knitted through an adjacent loop of filling thread along with the primary selvage thread and one of the auxiliary selvage threads.

3. The ribbon defined in claim 1, in which the auxiliary selvage threads are of different diameters.

4. The ribbon defined in claim 1, in which the auxiliary selvage threads are different yarns.

5. The ribbon defined in claim 1, in which at least one of the auxiliary selvage threads is a textured yarn.

6. The ribbon defined in claim 1, in which the auxiliary selvage threads are unshrunk yarns.

7. In a method of manufacturing a woven ribbon which includes forming successive sheds of warp threads and looping a filling thread into such successive sheds, the improvement comprising alternately knitting first one and then another of at least two auxiliary selvage threads into successive loops of the filling thread, respectively, along with a separate primary selvage thread which is knitted through each loop to form a selvage to deter raveling.

8. In the method defined in claim 7, positioning the auxiliary selvage threads at the top and bottom of each shed, respectively, and changing the respective positions of the auxiliary selvage threads as the next shed is formed.

9. In the method defined in claim 7, knitting each loop of filling thread into the previously-formed loop of filling thread along with the primary selvage thread and one of the auxiliary selvage threads.

* * * * *